US005711676A

United States Patent [19]

Michael, III

[11] Patent Number: 5,711,676

[45] Date of Patent: Jan. 27, 1998

[54] VERTICALLY MOUNTED CABLE PLUG

[75] Inventor: George W. Michael, III, Harrisburg, Pa.

[73] Assignee: The Whitaker Corporation, Wilmington, Del.

[21] Appl. No.: 591,996

[22] Filed: Jan. 26, 1996

[51] Int. Cl.[6] ..... H01R 9/09

[52] U.S. Cl. ..... 439/63; 439/581

[58] Field of Search ..... 439/63, 581, 578

[56] References Cited

U.S. PATENT DOCUMENTS

| | | | |
|---|---|---|---|
| 3,910,665 | 10/1975 | Stull | 439/63 |
| 3,915,535 | 10/1975 | O'Keefe et al. | 439/63 |
| 4,656,441 | 4/1987 | Takahashi et al. | 333/33 |
| 5,211,581 | 5/1993 | Schwartz et al. | 439/581 |
| 5,437,562 | 8/1995 | Michael | 439/581 |

OTHER PUBLICATIONS

AMP Guide to RF Connectors Catalog 82074: Micro–Miniature Connectors.

*Primary Examiner*—Neil Abrams
*Assistant Examiner*—Barry M. L. Standig

[57] ABSTRACT

The combination of a PCB surface mount receptacle and a miniaturized coaxial connector vertically mated therewith. The receptacle comprises a dielectric housing defined by a plurality of upstanding walls from a base, means for surface mounting the receptacle to the PCB, a grounding contact clip to be received therein, and a signal contact pin exposed within the interior of the receptacle. The connector comprises a T-shaped housing consisting of a first housing portion to be received in the grounding contact clip, and a second housing portion extending perpendicular thereto. The T-shaped housing further includes a central cavity extending axially through the second housing portion and transversely through the first housing portion. The cavity further contains an electrically isolated contact for engagement with the signal contact pin. Finally, the first housing portion further includes a pair of end extensions which cooperate with means in the receptacle to ensure mating alignment of the connector with the receptacle.

7 Claims, 4 Drawing Sheets 22
56
54
30
26
16
54
10
24
56
28
52
24
82
78
68
84
62
80
12
60
82
66
70
72
12
14
66
64

VERTICALLY MOUNTED CABLE PLUG

BACKGROUND OF THE INVENTION

This invention is directed to a miniaturized coaxial connector that is reliable and offers high performance. Such a connector is particularly suited for surface mount applications, where typical applications may be found in the areas of telecommunications, test equipment, copy equipment and microwave applications.

A recent innovation in the area of miniaturized coaxial connectors is found in U.S. Pat. No. 5,437,562, assigned to the assignee hereof, where the contents thereof are incorporated in its entirety in these specifications. The invention of such recent innovation, also by the inventor hereof, is directed to a low profile coaxial cable connector assembly for edge mounting to a planar electronic device, such as a printed circuit board. The assembly comprises a dielectric housing having at one end thereof a pair of spaced-apart, parallel walls adapted to straddle and be secured to the planar electronic device, and at the opposite end thereof a cavity for the reception of an electrically terminated coaxial cable. Within the other end a grounding contact clip is provided having a pair of parallely extending spring metal arms for receiving the terminated coaxial cable, and a signal contact for mating with the terminated coaxial cable. The grounding clip and signal contact further include extensions therefrom for electrically interconnecting to said planar electronic device, where the extensions are exposed between the spaced-apart walls and may be soldered to complementary traces or pads on the surfaces of the planar electronic device.

The present invention represents an alternative approach to this edge mounted coaxial connector and is similar in that it utilizes a grounding clip; however, in the preferred embodiment the clip vertically receives a coaxial cable assembly. The unique features of this invention will become more apparent to those skilled in the art, particularly when read in conjunction with the accompanying drawings.

SUMMARY OF THE INVENTION

The invention is directed to a miniaturized, vertically mated, coaxial connector and receptacle, where the receptacle is preferably mounted to a planar electronic device, such as a PCB. The receptacle comprises a dielectric housing defined by a plurality of upstanding walls from a base, means for surface mounting the receptacle to a planar electronic device, a grounding contact clip to be received therein, and a signal contact pin exposed within the interior thereof. The connector comprises a T-shaped housing consisting of a first housing portion to be received in the grounding contact clip, and a second housing portion extending perpendicular thereto. The T-shaped housing further includes a central cavity extending axially through the second housing portion and transversely through the first housing portion. Within the cavity there is located an electrically isolated contact for engagement with the signal contact pin. To ensure proper mating alignment, the first housing portion further includes a pair of end extensions which cooperate with slot means in the receptacle.

DETAILED DESCRIPTION OF PREFERRED EMBODIMENT

The present invention, as exemplified in the several Figures, relates to a miniaturized coaxial connector that is adapted to be vertically mated to a board mounted receptacle.

Figure 1:
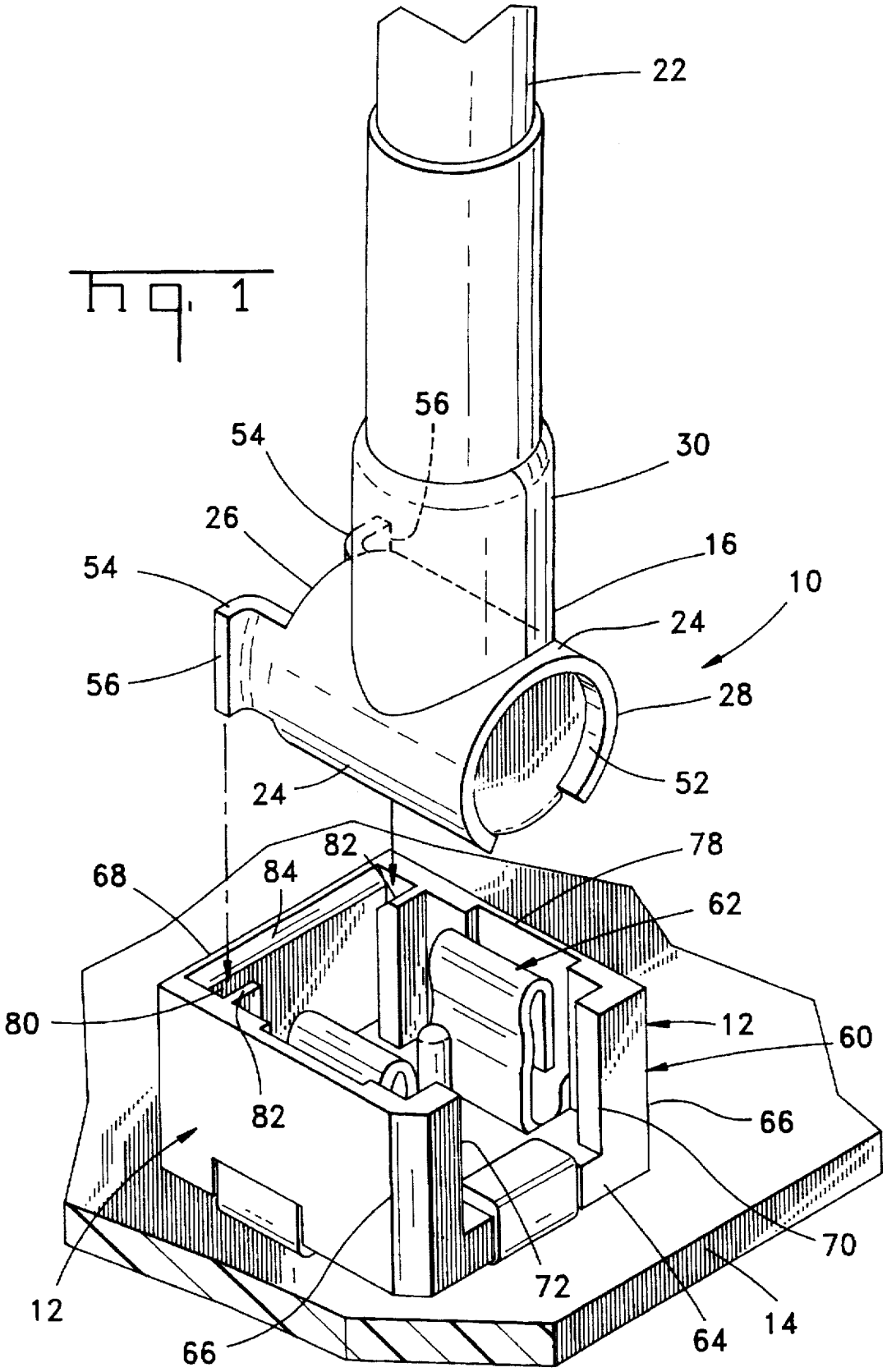
FIG. 1 is a perspective view of a vertically mounted coaxial connector and surface mounted receptacle, according to the teachings of this invention.
Figure 2:
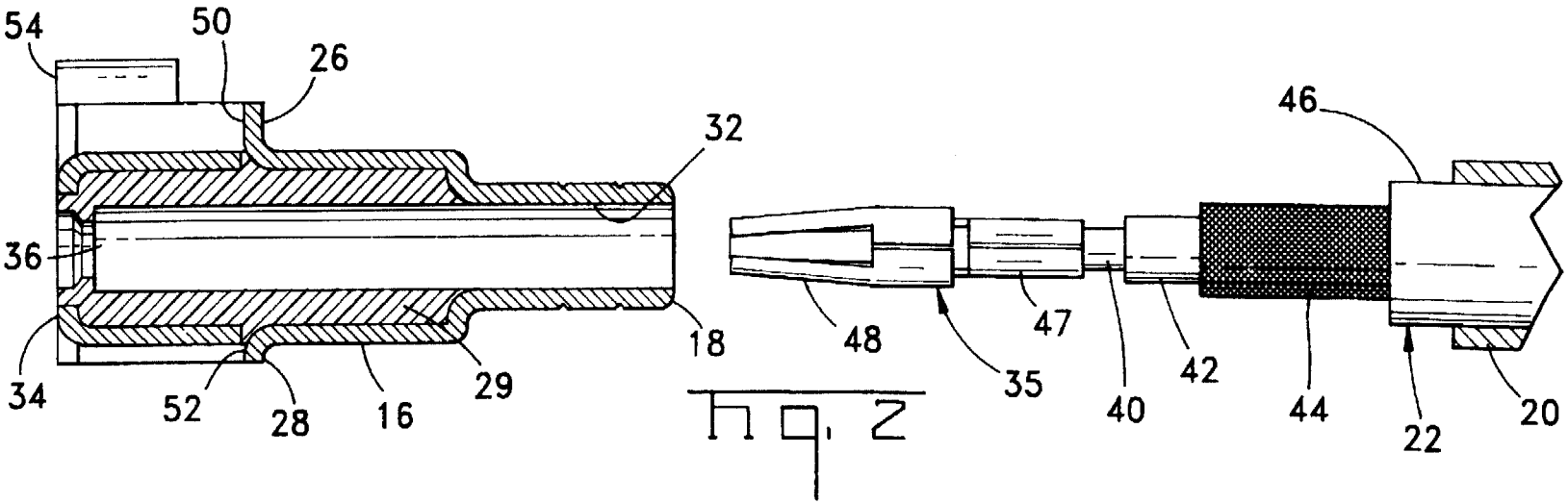
FIG. 2 is a partially sectioned view of the unloaded coaxial connector of this invention.
Figure 3:
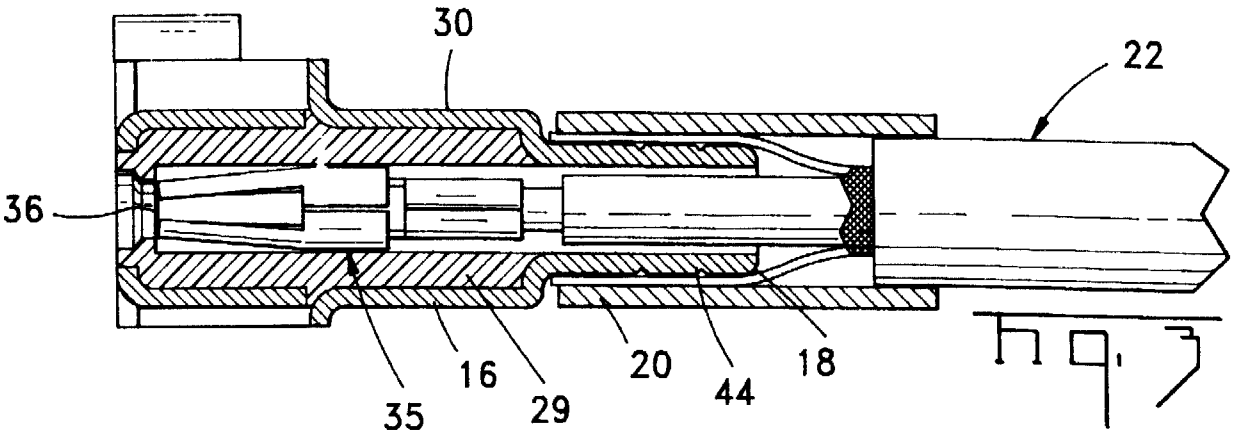
FIG. 3 is a partially sectioned view of the coaxial connector of FIG. 2, but in the loaded or assembled condition.
Figure 4:
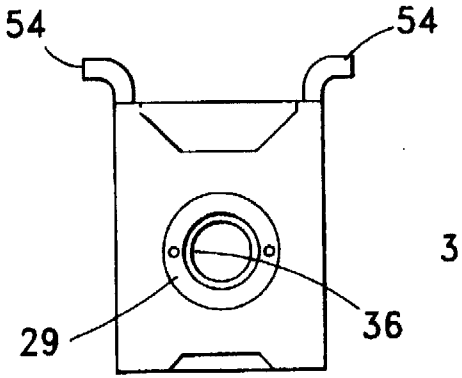
FIG. 4 is an end view of the connector of FIG. 3.
Figure 5:
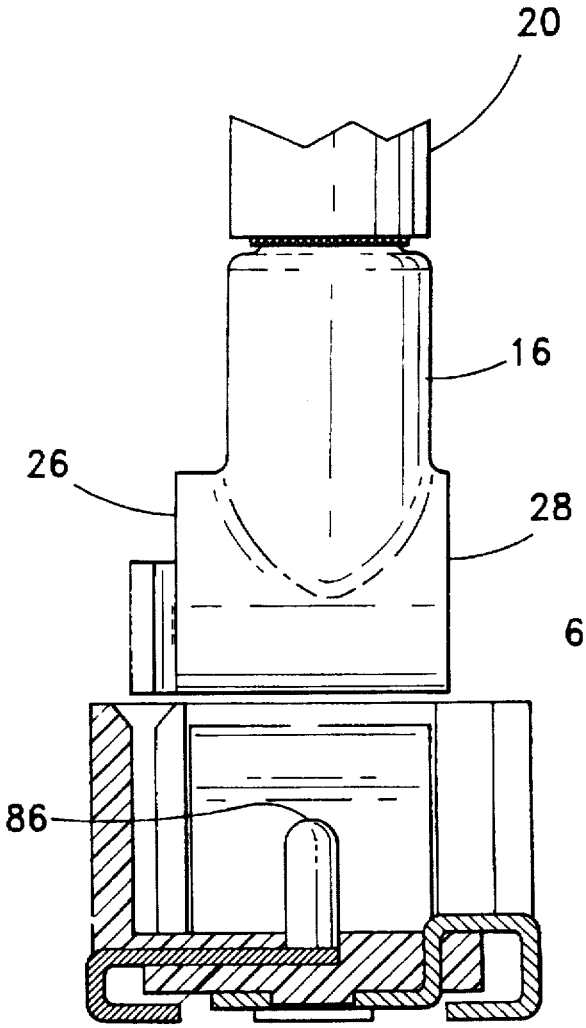
FIG. 5 is a partially sectioned side view showing the connector hereof poised for vertical entry into a complementary receptacle.

FIG. 1 illustrates the connector 10 of this invention, where the connector 10 is poised for mating to a receptacle 12 mounted to a planar electronic device 14, such as a printed circuit board. FIGS. 2 and 3 show further details and construction of the connector 10. Such connector comprises a T-shaped housing 16, a reduced concentric coax cable receiving end 18, and a ferrule or sleeve 20 for crimping thereabout to capture the coax braid and to secure the coaxial cable 22 therwithin.

The T-shaped housing 16 consists of a first cylindrical section 24, with first and second extensions 26,28, for receipt in the receptacle 12, and a cylindrical contact receiving section 30 integral with but disposed normal thereto. Extending through the coax cable receiving end 18 and through a dielectric insert 29 in the T-shaped housing 16 is a uniform central cavity 32 into which the assembled contact 35 is placed. At the mating end 34 of the central cavity 32, an inwardly directed flange 36 is provided as a stop for the contact 35.

By way of brief background, before describing the contact 35, the preferred cable 22 is a flexible or braided coaxial cable, meaning the signal and ground conductors are on the same center axis. The cable, as best seen in FIG. 2, comprises a central core 40 (signal conductor) surrounded by a dielectric layer 42, which in turn has a braided layer 44 (ground conductor) about the dielectric layer. Finally, this assembly is encased in an insulation layer 46.

Continuing with FIG. 2, the contact 35, stamped and formed from a sheet metal blank, as known in the art, includes a crimping portion 47, for securing the contact to the central core 40, and a socket-like contact end 48 for electrical engagement with a complementary post in the receptacle 12, as hereinafter explained. With the contact 35 assembled, as in FIG. 2, the electrically secured contact is inserted into and seated in the central cavity 32. With such insertion, the braided layer 44 is caused to override the reduced end 18, as seen in FIG. 3. Thereafter, the sleeve 20, initially positioned about the insulation layer 46, is moved toward the contact to capture the braided layer 44. With the sleeve 20 fully moved axially toward the contact receiving section 30, the sleeve 20 may be crimped thereabout to ensure an electrically secured assembly.

The T-shaped housing 16 includes the cylindrical section 24 with cylindrical first and second extensions 26,28, and recessed end members 50,52 adjacent the dielectric insert 29. A further feature of the cylindrical section 24 is a pair of wings 54, initially projecting axially from the first extension 26, then turned outwardly at about 90° at the ends 56 thereof. The function of such wings will become apparent in the description which follows.

The receptacle 12 consists of a dielectric housing 60 and a spring metal clip 62 positioned therewithin. The receptacle housing 60, as best illustrated in FIGS. 1 and 5 through 8, comprises a dielectric material, such as injection molded from plastic, and consists of a base 64, a pair of side walls 66, and end wall 68, and a front wall 70 with cut out 72 for receiving the second extension 28 of first cylindrical section 24 during mating of the assembly. The base 64 includes a pair of openings 74, adjacent the respective side walls 66 to receive the grounding contact clip 62. Within the cut out 72, the base 64 is provided with a tab receiving recess 76, for a grounding tab associated with the grounding contact clip 62.

Each side wall 66 is further provided with a recess or reduced wall portion 78, which as will be apparent hereinafter, allows for flexing of the grounding contact clip 62 during mating with the connector 10. Further, near the inner surface 80 of the end wall 68, a pair of alignment ribs 82 projecting from the respective side walls 66 are provided. Such ribs cooperate to define a slot 84 for receiving the pair of laterally extending wings 54 on the first cylindrical section 24.

A feature of the receptacle housing 60 is the provision of an integrally molded signal contact pin 86 therein, as illustrated in the several Figures. The contact pin 86, stamped and formed from a metal blank, features an upstanding, essentially circular post 88 to be exposed within the housing 12 (see FIG. 1) for engagement with contact 35, and an exposed tab 90 for electrical engagement with appropriate circuitry or traces along the planar assembly 14, as known in the art, see FIG. 5.

Figure 6:
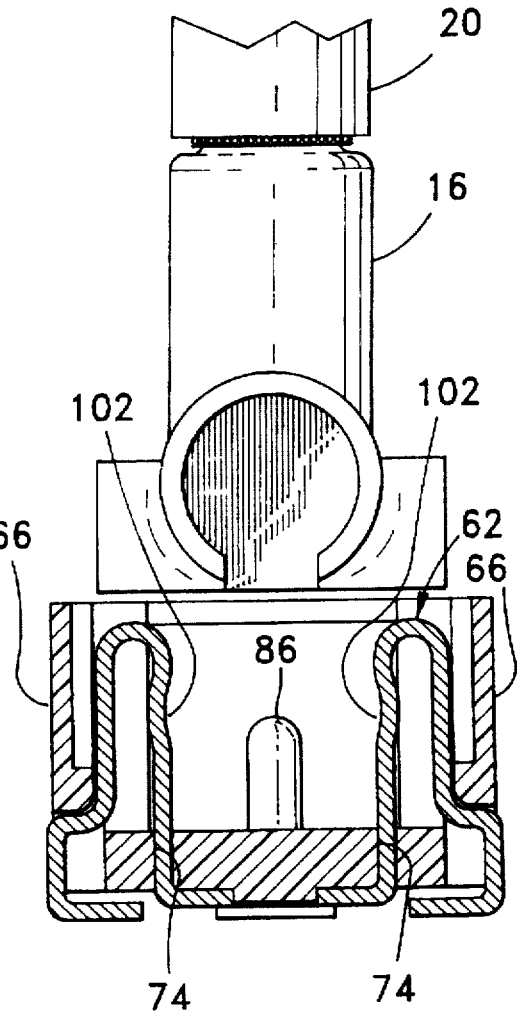
FIG. 6 is a partially sectioned front view of the connector and receptacle of FIG. 5.
Figure 7:
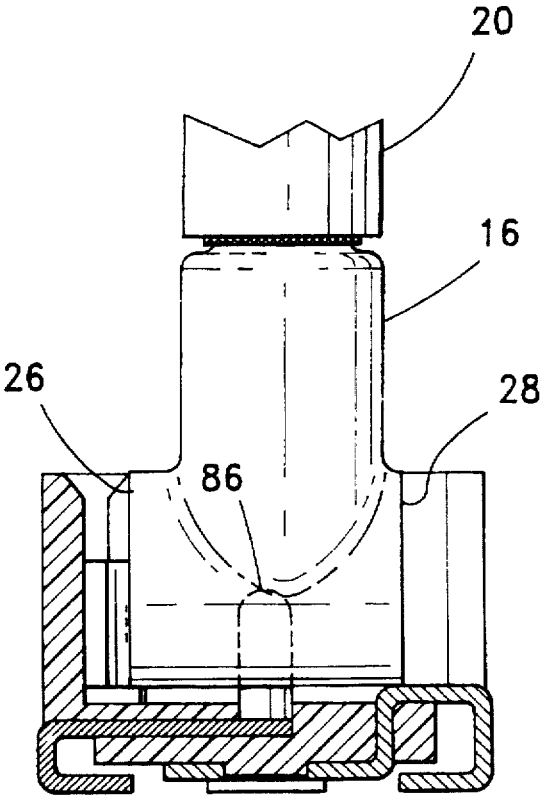
FIG. 7 is a partially sectioned side view, similar to FIG. 5, but showing a mated connector and receptacle.
Figure 8:
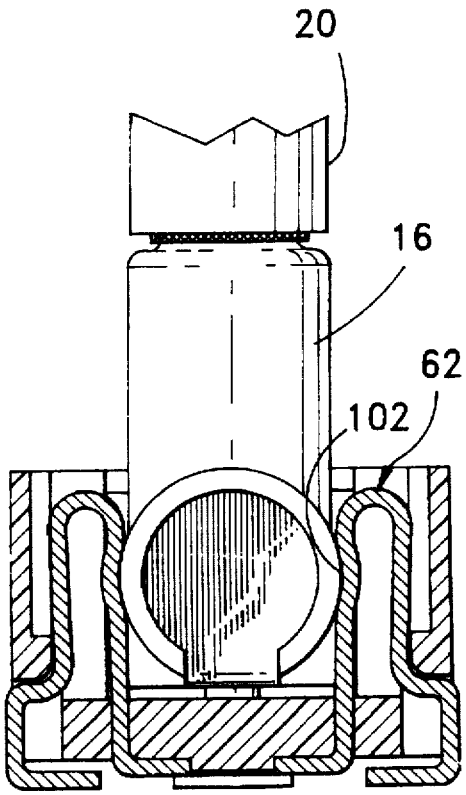
FIG. 8 is a partially sectioned front view, similar to FIG. 6, but showing a mated connector and receptacle.

The grounding contact clip 62, illustrated in section in FIG. 6, is an electrically conductive, spring metal stamped and formed from a metal blank. The contact clip 62 consists of a pair of upstanding arms 92, where the ends 94 are reverse bent 180° ending in a pair of inturned grounding tabs 96. The base 98 of the grounding contact clip 62 includes a central opening 100, which when joined with the housing 12, overrides the circular post 88. It will be observed that each arm 92 has been formed to provide opposing curved recesses 102 to facilitate seating therein of the connector 10.

To engage the connector 10 and receptacle 12, where the receptacle is preferably mounted to a planar electronic device 14, such as a PCB, the first cylindrical section 24 is moved toward and between the arms 92 of grounding clip 62 to settle within the respective curved recesses 102. Concurrently, the mating end 34 of the central cavity 32 is caused to override the contact pin 86, where such pin electrically engages contact end 48 of contact 35. To ensure the electrical engagement, the respective wings 54 are slidably received in the receptacle.

I claim:

1. The combination of a miniaturized coaxial connector and receptacle for vertical mounting thereto, the receptacle comprising a dielectric housing defined by a plurality of upstanding walls from a base, means for surface mounting said receptacle to a planar electronic device, a grounding contact clip to be received therein, and a signal contact pin exposed within the interior thereof, and the connector comprising a T-shaped housing consisting of a first housing portion to be received in said grounding contact clip, and a second housing portion extending perpendicular thereto, said T-shaped housing including a central cavity extending axially through said second housing portion and transversely through said first housing portion, said cavity containing an electrically isolated contact for engagement with said signal contact pin, where said first housing portion further includes a pair of end extensions which cooperate with means in said receptacle to ensure mating alignment of said connector with said receptacle.

2. The combination according to claim 1, wherein said T-shaped housing includes a coaxial cable secured to said contact through said second housing member.

3. The combination according to claim 1, wherein said grounding contact clip includes a pair of upstanding spring arms for snap engaging said first housing portion.

4. The combination according to claim 3, wherein said grounding contact clip includes plural tabs for engaging complementary grounding circuit traces on said planar electronic device.

5. The combination according to claim 4, wherein a remote end of said second housing portion includes a concentric reduced portion into which said coaxial cable is received, where said reduced portion includes at least one annular groove for engagement with a crimped ferrule thereabout.

6. The combination according to claim 5, wherein said coaxial cable includes a metal grounding braid which is captured between said reduced portion and said crimped ferrule.

7. The combination according to claim 1, wherein a pair of opposing walls, spaced from one of said upstanding walls of the receptacle, defines a slot for receiving said end extensions.

* * * * *